US006220128B1

(12) United States Patent
Hu

(10) Patent No.: US 6,220,128 B1
(45) Date of Patent: Apr. 24, 2001

(54) SHOCK ABSORBING HANDLE OF HAND IMPACT TOOL

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/541,192

(22) Filed: Apr. 3, 2000

Related U.S. Application Data

(63) Continuation-in-part of application No. 09/304,698, filed on May 4, 1999, now abandoned.

(51) Int. Cl.[7] ..... B25G 1/01
(52) U.S. Cl. ..... 81/489; 81/22
(58) Field of Search ..... 81/20, 22, 489; 16/DIG. 12

(56) References Cited

U.S. PATENT DOCUMENTS 811,390 * 1/1906 Foreman ..... 81/489
3,762,453 * 10/1973 Merrow et al. ..... 81/22
4,331,193 5/1982 Tudisco .
4,738,166 * 4/1988 Yamaguchi ..... 81/22
5,280,739 * 1/1994 Liou ..... 81/22
5,845,364 * 12/1998 Chen ..... 81/489

FOREIGN PATENT DOCUMENTS

628656 * 10/1961 (CA) ..... 81/22

* cited by examiner

*Primary Examiner*—Eileen P. Morgan
*Assistant Examiner*—Joni B. Danganan
(74) *Attorney, Agent, or Firm*—Alan Kamrath; Rider Bennett Egan & Arundel, LLP

(57) ABSTRACT

A handle of a hand impact tool includes a pair of axial passages defined therein and a first row of axially spaced transverse openings defined in an outer periphery thereof and communicated with one of the axial passages. A second row of axially spaced transverse openings are defined in the outer periphery and communicates with the other axial passage. The axial passages are located in upper and lower end portions of the handle and are semi-circular or crescent in cross section. When hammering an object, the handle deforms not only in the axial direction but also in the radial direction due to provision of the transverse openings to effectively absorb shock resulting from hammering.

16 Claims, 6 Drawing Sheets

SHOCK ABSORBING HANDLE OF HAND IMPACT TOOL

CROSS REFERENCE TO RELATED APPLICATION

This is a continuation-in-part application of U.S. patent application Ser. No. 09/304,698 filed on May 4, 1999, which is now abandoned.

BACKGROUND OF THE INVENTION

1. Field of the Invention

The present invention relates to a handle of a hand impact tool, e.g., a hammer, and more particularly to a hammer handle that may absorb shock by allowing the whole handle to deform.

2. Description of the Related Art

Hammer have been used for a long time and are still popular. The user's hand is subjected to shock when hammering. U.S. Pat. No. 4,331,193 to Tudisco issued on May 25, 1982 discloses a hammer handle made of a spring strip formed into an oblong closed figure and a synthetic resin handle body molded around the frame. The handle is allowed to flex for reducing the shock resulting from striking a workpiece. Nevertheless, formation of such a hammer handle is troublesome. U.S. Pat. No. 4,738,166 to Yamaguchi issued on Apr. 19, 1988 discloses a hammer having a pair of axially extending passages in a grip thereof to absorb shock by allowing the grip to deform when the hammer head strikes an object. As can be seen from FIGS. 3 and 4 of said patent, the radially extending openings are not communicated with axially extending passages and thus have an unsatisfactory shock absorbing result. U.S. Pat. No. 5,280,739 to Liou issued on Jan. 25, 1994 discloses a hammer with a hand grip having a pair of holes to allow the hand grip to be compressible and deformable such that vibrations and shocks transmitted to the hand grip can be absorbed. Nevertheless, the shock-absorbing effects provided by the hammer handles disclosed in both U.S. Pat. Nos. 4,738,166 and 5,280,739 are not satisfactory, as the shock is only transmitted and absorbed along the axial direction. U.S. Pat. No. 811,390 to Foreman issued on Jan. 30, 1906 discloses a tool handle including channels 5, orifices 7, and recesses 4 in which air entering the recesses 4 may escape via the orifices 7. The shock occurring during hammering is mainly in the vertical direction that is parallel to the longitudinal axis of the hammer head. Nevertheless, the recesses 4 and the channels 5 are too small for they are arranged along a peripheral edge of the tool handle and thus fail to provide satisfactory shock-absorbing effect. The present invention is intended to provide an improved hammer handle that mitigates and/or obviates the above problems.

SUMMARY OF THE INVENTION

It is a primary object of the present invention to provide a handle of a hand impact tool that may absorb shock more effectively by providing at least one axial passage in the handle and at least one transverse slot that is located in an outer periphery of the handle and communicated with the axial passage. The axial passage is located in an upper end portion or a lower end portion of the handle. In addition, the axial passage is substantially semi-circular or crescent shaped in cross section.

In accordance with an aspect of the invention, a handle of a hand impact tool comprises a pair of axial passages defined therein. A row of axially spaced first transverse openings defined in an outer periphery of the handle communicates with one of the axial passages. A row of axially spaced second transverse openings defined in the outer periphery of the handle communicates with the other axial passage. The handle further comprises two rows of axially spaced third transverse openings respectively formed on two sides of the row of axially spaced first transverse openings, each third transverse opening being defined in the outer periphery of the handle and communicated with said one of the axial passages. Two rows of axially spaced fourth transverse openings are respectively formed on two sides of the row of axially spaced second transverse openings, each fourth transverse opening being defined in the outer periphery of the handle and communicated with the other axial passage. The axial passages are substantially semi-circular or crescent shaped in cross section.

By such an arrangement, when hammering an object, the handle deforms not only in the axial direction but also in the radial transverse direction due to the provision of the transverse openings. Thus, shock as a result of hammering may be effectively absorbed not only in the axial direction but also in the radial direction.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
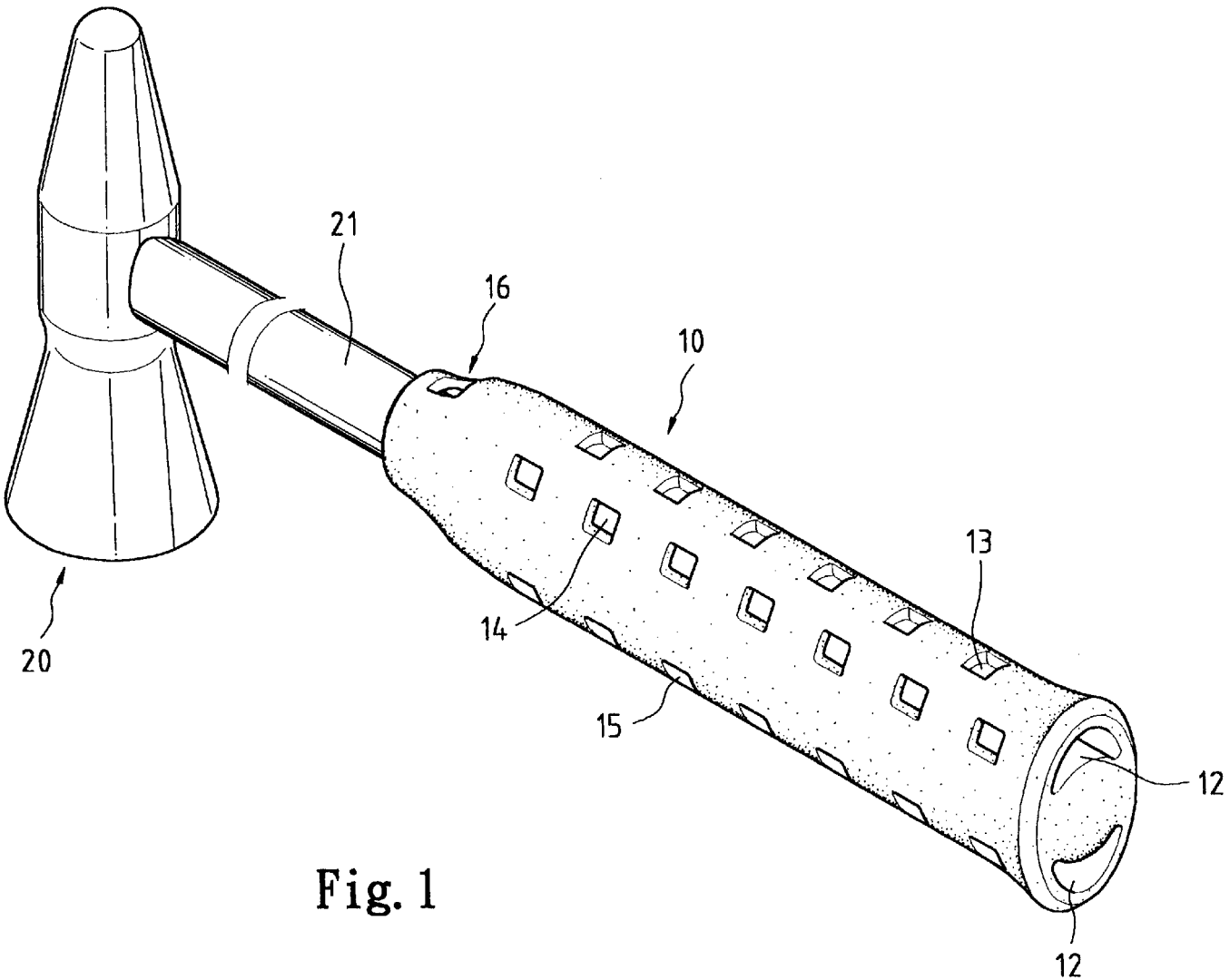
FIG. 1 is a perspective view of a hand impact tool with a handle in accordance with the present invention.
Figure 2:
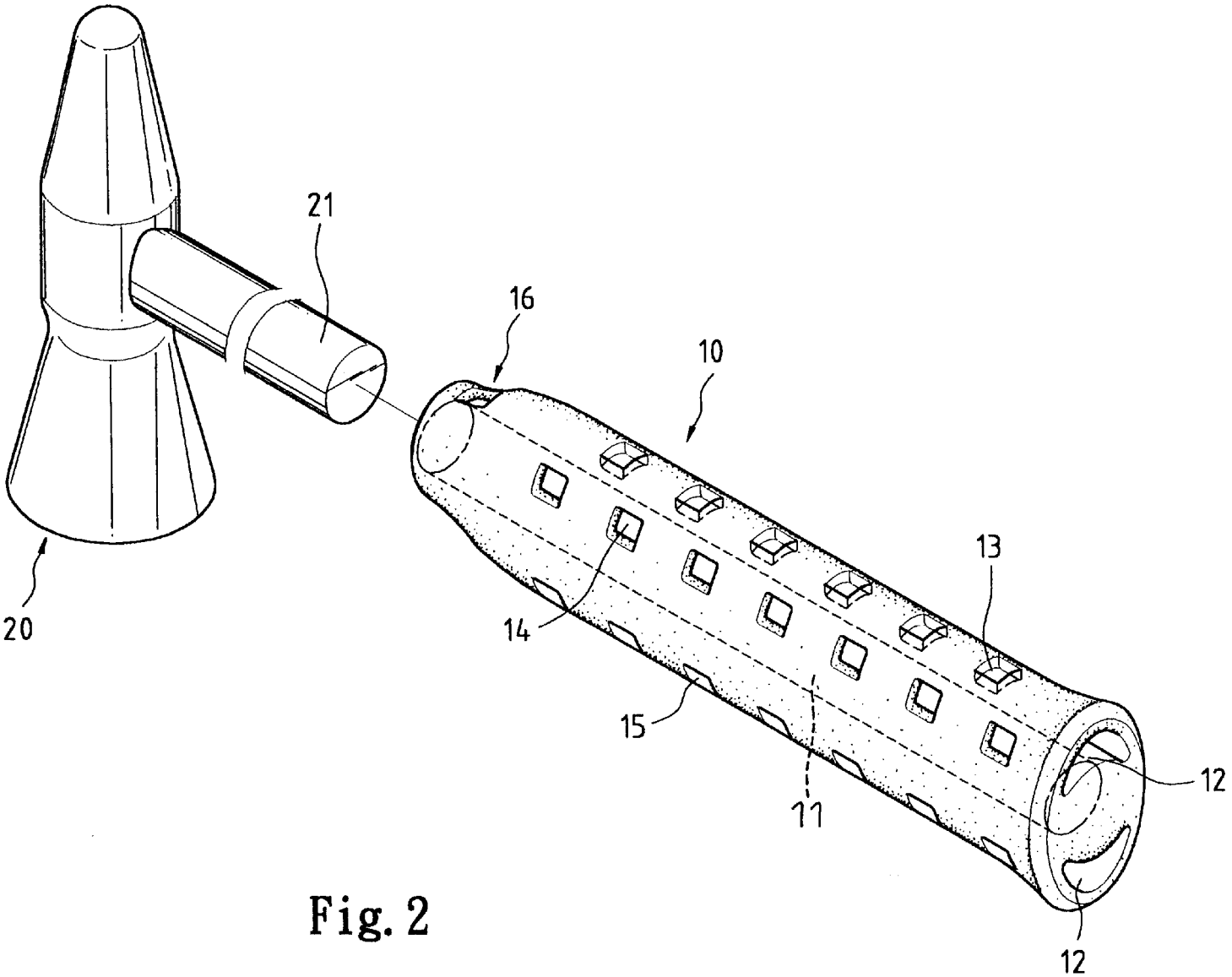
FIG. 2 is an exploded perspective of the hand impact tool.
Figure 4:
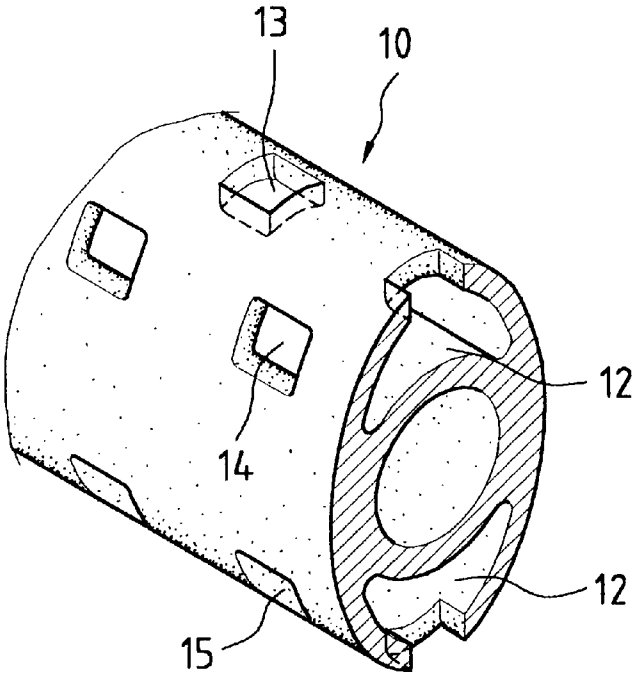
FIG. 4 is a perspective view of another portion of the handle in accordance with the present invention.
Figure 8:
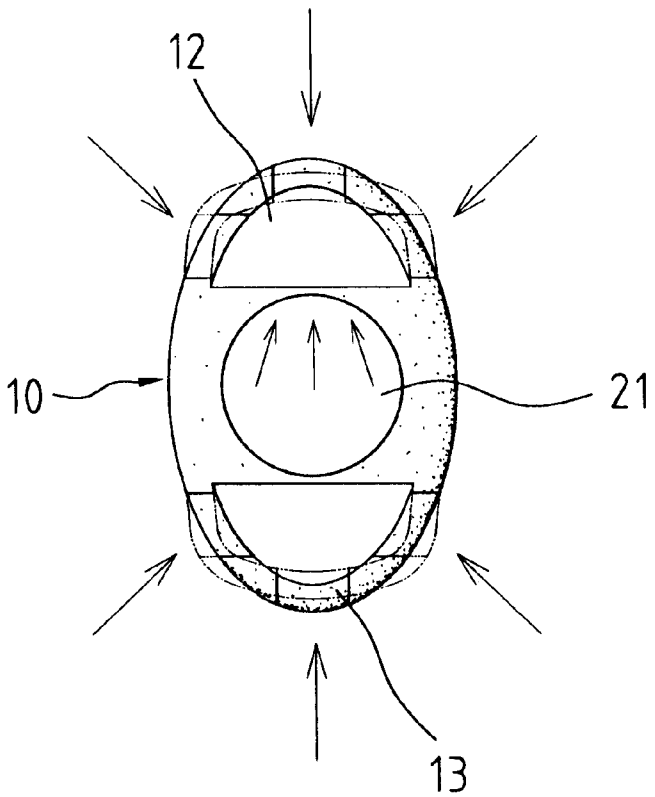
FIG. 8 is a view similar to FIG. 7, illustrating a modified embodiment of the handle in accordance with the present invention.

Referring to the drawings and initially to FIGS. 1 and 2, a handle 10 in accordance with the present invention is provided to a hand impact tool, e.g., a hammer having a head 20 with a stem 21. The handle includes 10 a compartment 11 (FIG. 2) for securely receiving an end of the stem 21. The handle 10 comprises a pair of axial passages 12 defined therein. The axial passages 12 are respectively located in upper and lower end portions of the handle 10. The axial passages 12 are substantially crescent or semi-circular (FIG. 8) shaped in cross section. In addition, at least one transverse opening is defined in an outer periphery of the handle 10 and communicated with one of the axial passages 12. In this embodiment, the transverse opening is the one (see opening 16) defined in an end of the handle 10 adjacent to the head 20 of the hammer.

Figure 3:
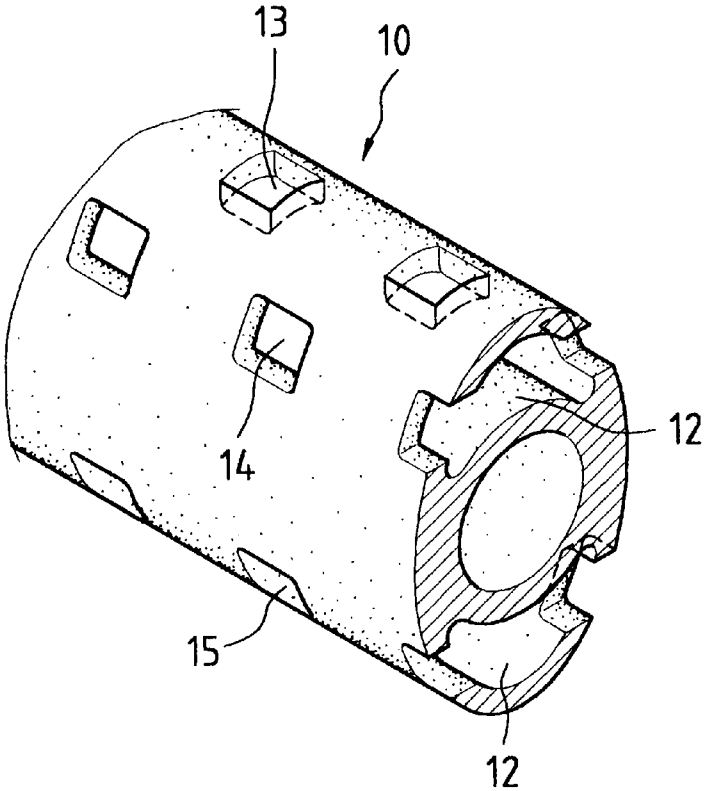
FIG. 3 is a perspective view of a portion of the handle in accordance with the present invention.

In a preferred embodiment of the invention, a row of axially spaced transverse openings 13 is defined in the outer periphery of the handle 10 and communicated with the upper axial passage 12, and another row of axially spaced transverse openings 13 is defined in the outer periphery of the handle 10 and communicated with the lower axial passage 12. Furthermore, two rows of axially spaced transverse openings 14 are respectively formed on two sides of the row of axially spaced transverse openings 13, each transverse opening 14 being defined in the outer periphery of the handle 10 and communicated with the upper axial passage 12, as shown in FIG. 3. Two further rows of axially spaced transverse openings 15 are respectively formed on two sides of the row of axially spaced transverse openings 13 on the lower side of the handle 10, each transverse opening 15 being defined in the outer periphery of the handle and communicated with the lower axial passage 12.

Figure 6:
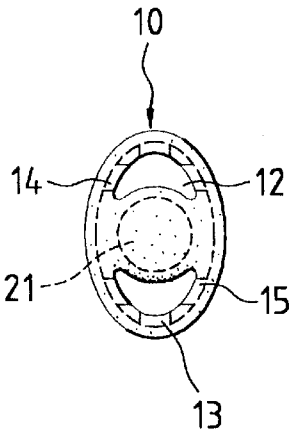
FIG. 6 is an end view of the handle.
Figure 5:
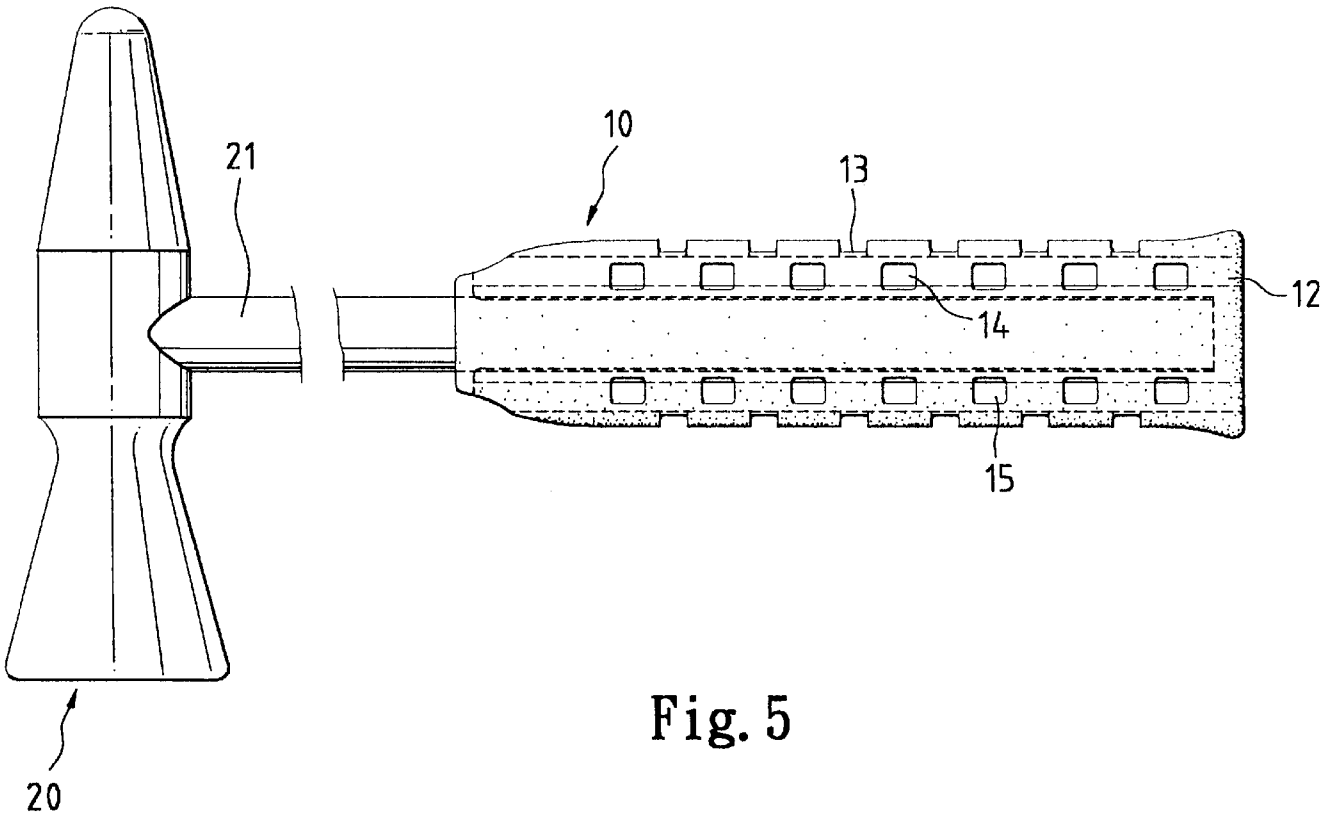
FIG. 5 is a side view of the hand impact tool.
Figure 7:
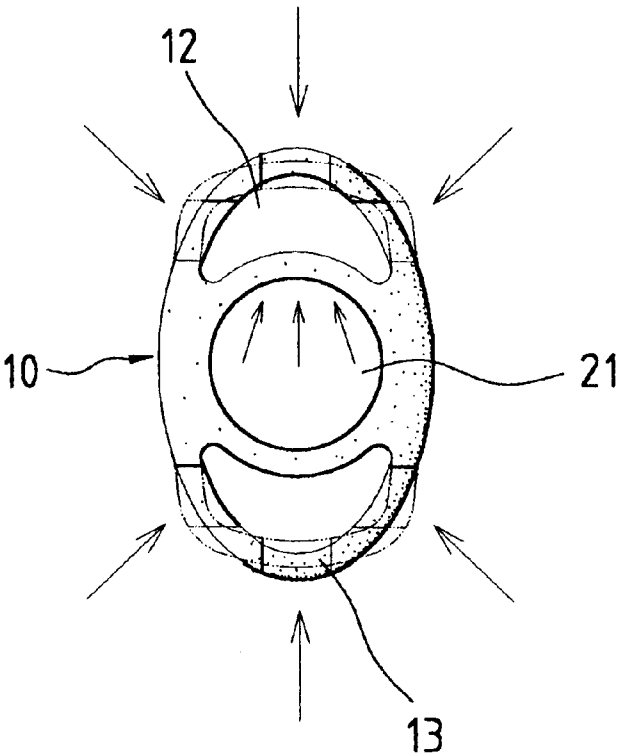
FIG. 7 is an end view of handle illustrating the shock-absorbing operation.

FIG. 5 is a side view of the hammer and FIG. 6 is an end view of the handle. FIG. 7 is an end view of the handle illustrating the shock-absorbing operation. When hammering an object, the handle deforms not only in the axial direction but also in the radial direction due to the provision of the transverse openings 13, 14, 15, and 16. Thus, shock as a result of hammering may be effectively absorbed not only in the axial direction but also in the radial direction. The number of the transverse openings 13, 14, 15, 16 is chosen in response to material of the handle. More openings 13, 14, 15, and 16 may be provided if the handle 10 is rigid, and less openings 13, 14, 15, and 16 are provided if the handle 10 is made of a softer material. It is noted that the provision of the axial passages 12 in the upper and/or lower portions of the handle 10 may provide better shock-absorbing effect, as it meets the optimal ergonomic design when taking the holding situation of the hammer by a user's hand. Namely, a user usually holds the handle completely such that the shock is mainly in the vertical direction (i.e., the usual hammering direction that is parallel to the longitudinal axis of the hammer head 20). The axial passages 12 defined in the upper and lower end portions of the handle 10 may be sufficiently large for providing satisfactory shock-absorbing function. In addition, the crescent or semi-circular cross sectional configuration of the axial passages 12 assists in the shock-absorbing effect. This is because the crescent or semi-circular cross sectional configuration of the axial passages 12 provides the largest sectional area and volume for the limited space in the handle of the impact tool. Namely, the axial passages 12 will have the largest volume when they have a crescent or semi-circular shape in cross-section, thereby providing the best shock-absorbing effect. In addition, the axial passages are respectively defined in the upper end portion and the lower end portion of the handle, which further assists in shock-absorption. In conclusion, the crescent or semi-circular cross sectional axial passages defined in the upper end portion and the lower end portion of the handle are an ergonomic design that provides the best shock-absorbing effect.

Although the invention has been explained in relation to its preferred embodiment, it is to be understood that many other possible modifications and variations can be made without departing from the spirit and scope of the invention as hereinafter claimed.

What is claimed is:

1. A handle of a hand impact tool, the handle comprising an outer periphery and a compartment for securely receiving the hand impact tool, the handle further comprising an axial passage defined therein and spaced from the compartment, and at least one transverse opening defined in the other periphery and communicated with the axial passage, the axial passage being located in an end portion of the handle.

2. The handle in claim 1, wherein said at least one transverse opening is defined in an end of the handle adjacent to a head of the hand impact tool.

3. The handle as claimed in claim 1, wherein the axial passage has semi-circular cross sections.

4. The handle as claimed in claim 1, wherein the axial passage has crescent shaped cross section.

5. The handle as claimed in claim 1, wherein said at least one transverse opening is defined in an end of the handle adjacent to a head of the hand impact tool.

6. A handle of a hand impact tool, the handle comprising an outer periphery and a compartment for securely receiving the hand impact tool, the handle further comprising two axial passages defined therein and spaced from the compartment, and at least one transverse opening defined in the outer periphery and communicated with one of the axial passages, the axial passages being located in an upper end portion and a lower end portion of the handle, respectively.

7. The handle as claimed in claim 6, wherein said at least one transverse opening is defined in an end of the handle adjacent to a head of the hand impact tool.

8. The handle as claimed in claim 6, wherein the axial passage have semi-circular cross sections.

9. The handle as claimed in claim 6, wherein the axial passages have crescent shaped cross sections.

10. The handle as claimed in claim 6, wherein said at least one transverse opening is defined in an end of the handle adjacent to a head of the hand impact tool.

11. A handle of a hand impact tool, the handle comprising an outer periphery, the handle further comprising a pair of axial passages defined therein, and a row of axially spaced first transverse openings defined in the outer periphery and communicated with one of the axial passages, a row of axially spaced second transverse openings defined in the outer periphery and communicated with the other axial passage, and further comprising two rows of axially spaced third transverse openings respectively formed on two sides of the row of axially spaced first transverse openings, each said third transverse opening being defined in the outer periphery and communicated with said one of the axial passages.

12. The handle as claimed in claim 11, further comprising two rows of axially spaced fourth transverse openings respectively formed on two sides of the row of axially spaced second transverse openings, each said fourth transverse opening being defined in the outer periphery and communicated with the other axial passage.

13. The handle as claimed in claim 12, wherein the axial passages are located on an upper end portion and a lower end portion of the handle, respectively.

14. The handle as claimed in claim 13, wherein the axial passages have semi-circular cross sections.

15. The handle as claimed in claim 13, wherein the axial passages have crescent shaped cross sections.

16. The handle as claimed in claim 11, wherein said at least one transverse opening is defined in an end of the handle adjacent to a head of the hand impact tool.

* * * * *